US007624521B2

(12) United States Patent
White, III et al.

(10) Patent No.: US 7,624,521 B2
(45) Date of Patent: Dec. 1, 2009

(54) SNOWTHROWER CHUTE CONTROL

(75) Inventors: Donald M. White, III, Chanhassen, MN (US); Brett P. Yeager, Bloomington, MN (US); Nathan J. Friberg, Bloomington, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 11/650,354

(22) Filed: Jan. 5, 2007

(65) Prior Publication Data

US 2008/0163520 A1 Jul. 10, 2008

(51) Int. Cl.
*E01H 5/09* (2006.01)

(52) U.S. Cl. ..... 37/260; 37/262; 180/19.3

(58) Field of Classification Search ..... 37/260–262, 37/257–259

See application file for complete search history.

(56) References Cited

U.S. PATENT DOCUMENTS

| | | | | |
|---|---|---|---|---|
| 2,642,680 | A | 6/1953 | Curtis et al. | |
| 7,735,199 | | 2/1956 | Wanner et al. | |
| 3,466,767 | A | 9/1969 | Rubin | |
| 3,468,041 | A | 9/1969 | Mattson et al. | |
| 3,509,977 | A * | 5/1970 | Bacon | 193/22 |
| 3,879,866 | A * | 4/1975 | Gunderson | 37/260 |
| 3,921,315 | A * | 11/1975 | Tome | 37/260 |
| 4,150,501 | A * | 4/1979 | Hayashi | 37/246 |
| 4,667,459 | A * | 5/1987 | Scanland et al. | 56/11.3 |
| 4,862,607 | A * | 9/1989 | Wacker | 37/260 |
| 5,735,064 | A * | 4/1998 | Holl | 37/260 |
| 6,487,798 | B2 * | 12/2002 | Sueshige | 37/260 |
| 6,499,238 | B2 * | 12/2002 | Kluck et al. | 37/261 |
| 6,622,464 | B2 * | 9/2003 | Goman et al. | 56/16.9 |
| 6,952,893 | B1 | 10/2005 | Sanderson | |
| 7,032,333 | B2 | 4/2006 | Friberg et al. | |
| 7,194,827 | B2 * | 3/2007 | Mercer et al. | 37/260 |
| 7,347,013 | B2 * | 3/2008 | Deschler et al. | 37/260 |
| 7,472,500 | B2 * | 1/2009 | White, III | 37/262 |

OTHER PUBLICATIONS

Annotated Drawing of MTD/Husqvama Snowthrower Chute Control (undated but admitted prior art).

* cited by examiner

*Primary Examiner*—Thomas A Beach
(74) *Attorney, Agent, or Firm*—James W. Miller

(57) ABSTRACT

A snowthrower has a rotatable chute that directs the snow stream in different directions depending on the rotational position of the chute. A slidable hand grip is mounted on one of the handle tubes of the snowthrower. The hand grip can be slid down the handle tube by the operator to rotate the chute in a first direction. The hand grip can be slid up the handle tube by the operator to rotate the chute in a second opposite direction. The hand grip includes a rounded knob that the operator can grip with one hand. A latch is provided to lock the hand grip in an adjusted position on the handle tube.

11 Claims, 8 Drawing Sheets

SNOWTHROWER CHUTE CONTROL

TECHNICAL FIELD

This invention relates to snowthrowers having a rotatable chute for adjusting the direction of a snow stream thrown by the snowthrower. More particularly, this invention relates to a control for conveniently rotating the chute to allow precise placement of the snow stream.

BACKGROUND OF THE INVENTION

Snowthrowers are known having upright chutes through which a snow stream is thrown. Such chutes are rotatable about a vertical axis to vary the direction of the snow stream being thrown through the chute. If the chute points forwardly, then the snow stream will be thrown forwardly in front of the snowthrower. However, if the chute is rotated to one side or the other, then the snow stream will be thrown laterally to the side to which the chute is directed. The chute can be placed in intermediate rotated positions where the snow stream is thrown both partially forwardly and partially to one side.

Various controls have been used to permit the operator to rotate the chute. Perhaps the simplest of these is a U-shaped hand grip secured to the back of the chute. The operator simply grips and manually pushes or pulls the hand grip to apply rotational leverage to the chute. This rotates the chute about the base of the chute where the chute rotatably connects to the housing of the snowthrower.

However, the chute and thus the hand grip are positioned forwardly of the handle assembly of the snowthrower. The operator normally walks behind the handle assembly of the snowthrower when operating the snowthrower. Thus, the act of adjusting the direction of the chute requires that the operator come around from behind the handle assembly of the snowthrower to reach the chute and to grip the hand grip.

This can be inconvenient and annoying to do particularly when the direction of the snow stream has to be frequently changed. For example, in blowing snow off a driveway, it is not unusual for the operator to make side-by-side passes up and down the driveway in opposite directions. If the only clear space for throwing the snow is on one side of the driveway, then the operator has to change the direction of the chute by 180° or so at the beginning of each pass.

Some chute controls comprise rotatable mechanical linkages that extend between the chute and the handle assembly of the snowthrower. These linkages terminate in a handle that the operator can use to rotate the linkage and thereby to rotate the chute. In this arrangement, the chute adjustment is somewhat more convenient for the operator since it can be done from behind the handle assembly. The operator need not walk around in order to reach the chute, but can adjust the chute simply by gripping the handle of the linkage and using the handle to rotate the linkage.

While such controls are within reach of the operator while the operator stands behind the handle assembly, they are mechanically more complicated and are still somewhat cumbersome to use. For example, the operator must usually crank or rotate the linkage quite a few times to swing the chute all the way from one side to the other. Again, if the chute has to be frequently swung all the way from one side to the other, as in the driveway example in set forth above, chute adjustment can still be a time consuming and annoying operation.

U.S. Pat. No. 7,032,333, which is owned by the assignee of this invention, discloses a chute control in which the rotatable crank type linkage is replaced with a pivotal joystick type control. The joystick is mounted on an escutcheon plate carried at the top of the handle assembly. The operator can grip the joystick and swing it laterally from one side to the other to rotate the chute in corresponding lateral directions. There is a mechanical advantage between the joystick and the chute such that the chute will rotate through its whole range of angular motion as the joystick pivots through its lateral range of motion. This eases the task of adjusting the chute since multiple turns of a rotatable crank type linkage are no longer required.

However, the joystick is still coupled to the chute through a forwardly extending mechanical linkage that passes between the handle assembly and the chute over the back of the snowthrower housing. Moreover, the joystick is positioned immediately in front of the operator. This along with the pivotal mounting needed for the joystick requires that the joystick be located on some type of escutcheon plate that is carried on the handle assembly. Accordingly, the joystick control described above and shown in the assignee's prior patent is still mechanically complex and is best suited for larger and more expensive snowthrowers.

There is a need in the snowthrower art for a simpler, less expensive and durable control for quickly and easily operating the chute on a snowthrower, particularly on smaller snowthrowers having a simple U-shaped handle assembly.

SUMMARY OF THE INVENTION

One aspect of this invention relates to an improved snowthrower of the type having a chute rotatable about a substantially vertical axis for directing a snow stream being thrown by the snowthrower, a handle assembly comprising a pair of upwardly and rearwardly extending, laterally spaced handle tubes, and a control on the snowthrower for operating the chute. The improvement relates to the control which comprises a slidable hand grip carried on one of the handle tubes of the snowthrower for sliding upwardly and downwardly along a portion of the length of the one handle tube. At least one flexible connection member couples the hand grip to the chute for rotating the chute in opposite directions when the hand grip is slid up and down on the one handle tube respectively.

Another aspect of this invention relates to an improved snowthrower of the type having a chute rotatable about a substantially vertical axis for directing a snow stream being thrown by the snowthrower, a handle assembly for allowing an operator to walk behind the snowthrower while guiding the snowthrower, and a control on the snowthrower for operating the chute. The improvement relates to the control which comprises a slidable control that is accessible to the operator while the operator stands behind the handle assembly of the snowthrower. The control is large enough to permit the operator to grip the control and slide the control in a first direction and in a second opposed direction. First and second flexible connection members operatively connect the slidable control and the chute for rotating the chute in opposite directions as the slidable control is slid in the first and second directions. The connection members are connected to the slidable control such that the first connection member is pulled when the slidable control is slid in the first direction and the second connection member is pulled when the slidable control is slid in the second direction.

Yet another aspect of this invention relates to a snowthrower which comprises a frame. Snow removal components on the frame gather snow from the ground and throw the gathered snow in a snow stream away from the snowthrower. A rotatable chute on the frame directs the snow stream in different directions depending on the rotational position of the chute. A handle assembly on the snowthrower has at least one upwardly and rearwardly extending handle tube connected to the frame. A slidable hand grip is mounted on the handle tube of the snowthrower. The hand grip can be slid down the handle tube by an operator to rotate the chute in a first direction and the hand grip can be slid up the handle tube by the operator to rotate the chute in a second opposite direction.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

One embodiment of a snowthrower chute control according to this invention is illustrated generally as 2 in FIGS. 1-8. A typical snowthrower of the type with which control 2 may be used is illustrated generally as 4. Snowthrower 4 may be any snowthrower incorporating suitable snow removal components for gathering snow from the ground and for throwing the gathered snow in a snow stream away from the snowthrower. Thus, snowthrower 4 may be either a single stage snowthrower having a single snow gathering and throwing impeller 5. Alternatively, snowthrower 4 could be a two stage snowthrower having an auger for gathering snow as well as an impeller for throwing the snow gathered by the auger.

Figure 1:
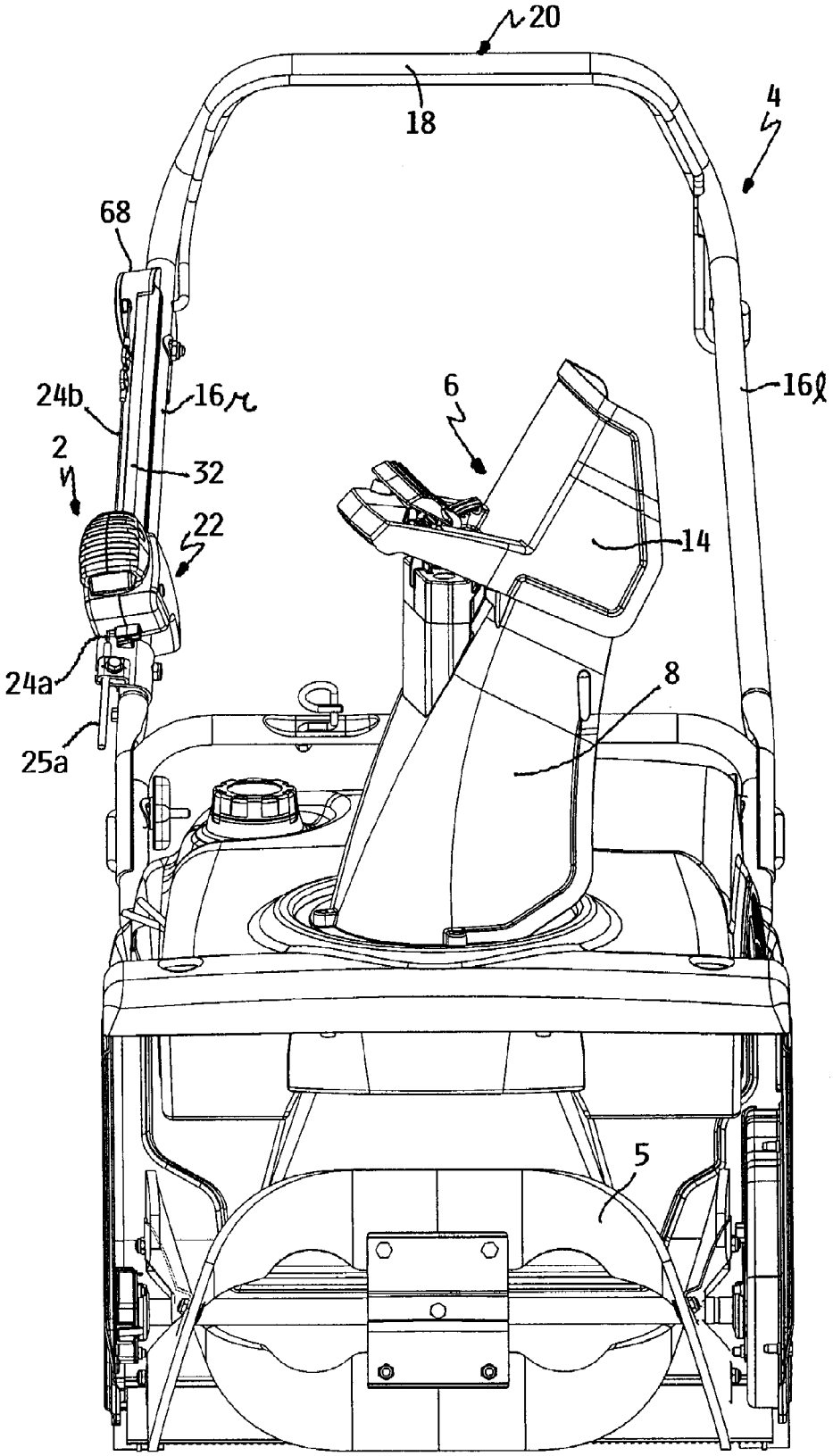
FIG. 1 is a front plan view of a snowthrower having a chute control according to this invention, particularly illustrating the chute of the snowthrower having been rotated fully to one side of the snowthrower housing.
Figure 2:
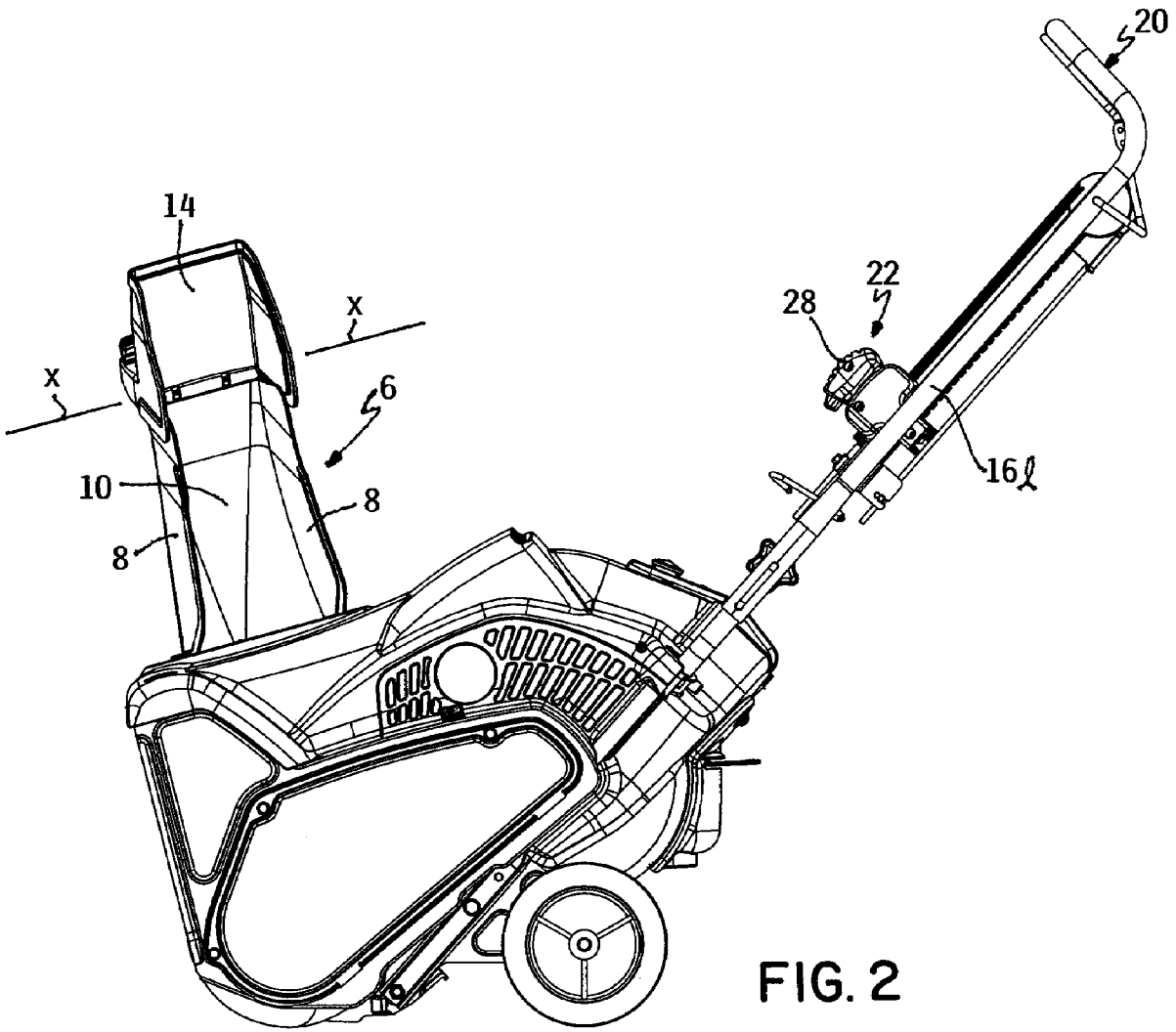
FIG. 2 is a side elevational view of the snowthrower of FIG. 1.

Snowthrower 4 is also of the type having a generally upright or vertically extending chute 6 through which the snow stream is thrown. As shown in FIGS. 1 and 2, chute 6 is generally U-shaped having spaced, parallel side walls 8 connected together by a back wall 10. The bottom or base of chute 6 is fixed to a driven gear 85 that serves to rotatably mount chute 6 on snowthrower 4 for rotation about a generally vertical axis y. See FIG. 3. Rotation of chute 6 about vertical axis y adjusts the direction of the snow stream relative to snowthrower 4 as will be described more fully hereafter.

The top of chute 6 carries a pivotal deflector 14. Deflector 14 is also U-shaped but is slightly larger than the top of chute 6 such that the top of chute 6 nests within the bottom of deflector 14. Deflector 14 pivots on the top of chute 6 about a generally horizontal axis x. See FIG. 2. Pivoting of deflector 14 about generally horizontal axis x adjusts the trajectory of the snow stream being thrown by chute 6. However, pivotal deflector 14 forms no part of this invention and could be deleted from chute 6 if so desired.

Snowthrower 4 has a generally U-shaped handle assembly 20. Handle assembly 20 includes a pair of laterally spaced, rearwardly and upwardly extending handle tubes 16, namely a left handle tube $\mathbf{16}_l$ and a right handle tube $\mathbf{16}_r$. Handle tubes 16 are connected together by a transverse cross member 18. The operator guides snowthrower 4 while walking behind handle assembly 20 and while gripping cross member 18.

Rotatable chute 6 and pivotal deflector 14 as disclosed herein are of the type commonly found on snowthrowers. There is nothing novel about chute 6 and deflector 14 per se. Rather, this invention relates to control 2 for rotating chute 6 about vertical axis y.

Control 2 of this invention includes a hand grip 22 that is slidably carried on one rearwardly and upwardly extending handle tube 16 of handle assembly 20 of snowthrower 4. Hand grip 22 is mounted to right handle tube $\mathbf{16}_r$ of handle assembly 20. Hand grip 22 can be slid up and down on handle tube $\mathbf{16}_r$ by the operator as the operator stands behind handle assembly 20. Hand grip 22 is linked to chute 6 by a pair of flexible Bowden cables 23 such that the up and down sliding motion of hand grip 22 rotates chute 6 in opposite directions about vertical axis y.

Figure 6:
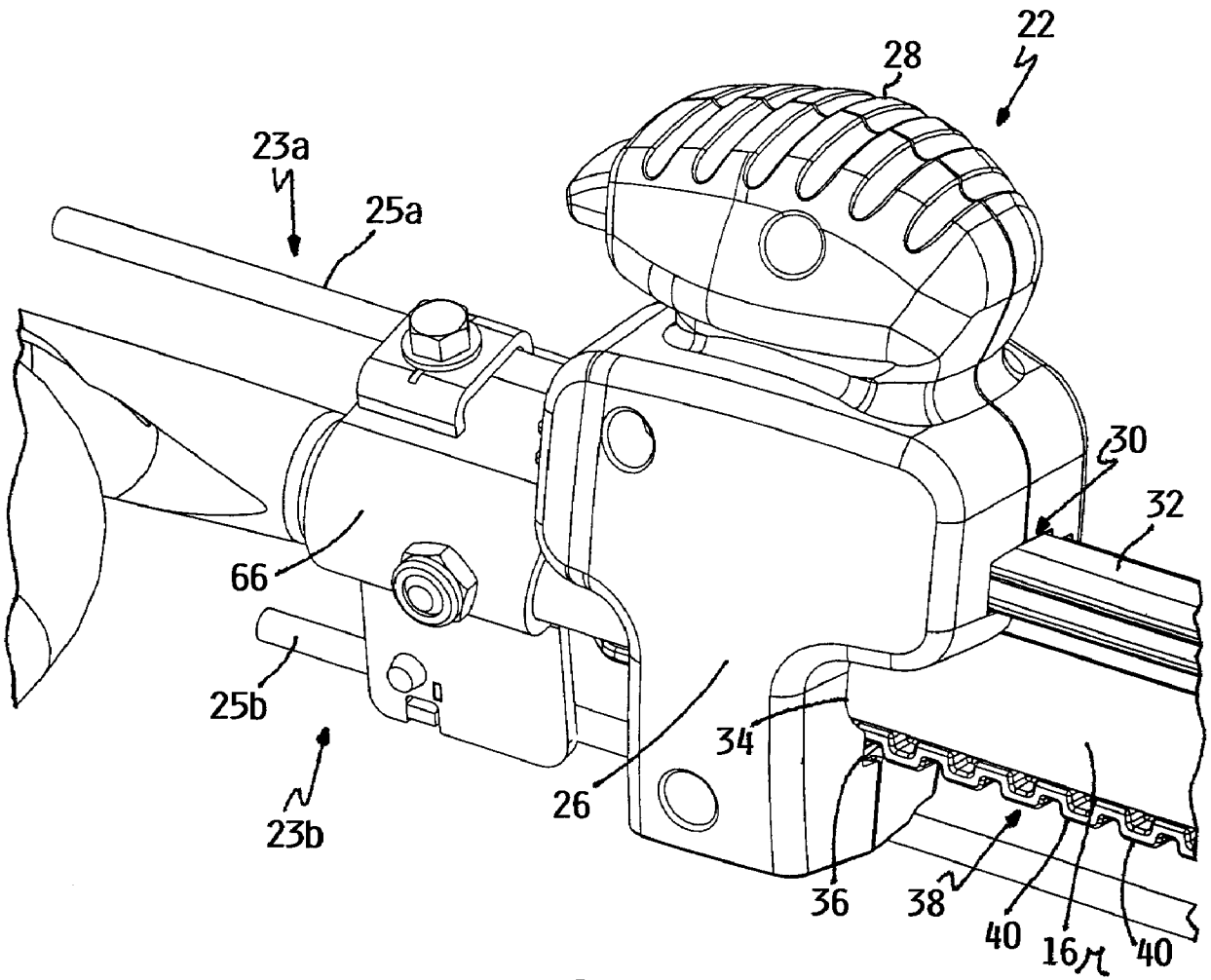
FIG. 6 is a perspective view of a portion of the slidable chute control of the snowthrower of FIG. 1, particularly illustrating the slidable hand grip of the control located atop one of the handle tubes of the handle assembly.

Referring now to FIG. 6, slidable hand grip 22 comprises a T-shaped housing 26 having a rounded knob 28 atop housing 26. The upper portion of housing 26, namely the shoulders of the T-shape, has a slideway 30 that receives a guide rail 32. Guide rail 32 and slideway 30 have mating cross-sectional configurations, i.e. guide rail 32 and slideway 30 both have generally rectangular cross-sectional configurations. Guide rail 32 is fixed to the top of handle tube $\mathbf{16}_r$ with the upper portion of housing 26 riding on guide rail 32 above the top of handle tube 16.

The lower portion of housing 26, namely the stem of the T-shape, includes a rounded passageway 34 through which handle tube $\mathbf{16}_r$ extends. The bottom end of the lower portion of housing 26 extends below handle tube $\mathbf{16}_r$ and includes another slideway 36 shaped to slidably receive a rack 38 fixed or carried on the underside of handle tube $\mathbf{16}_r$. Rack 38 is serrated to have a plurality of downwardly facing teeth 40. Rack 38 cooperates with a latch 44 carried inside hand grip 22 to lock or fix the position of hand grip 22 along handle tube $\mathbf{16}_r$.

Figure 7:
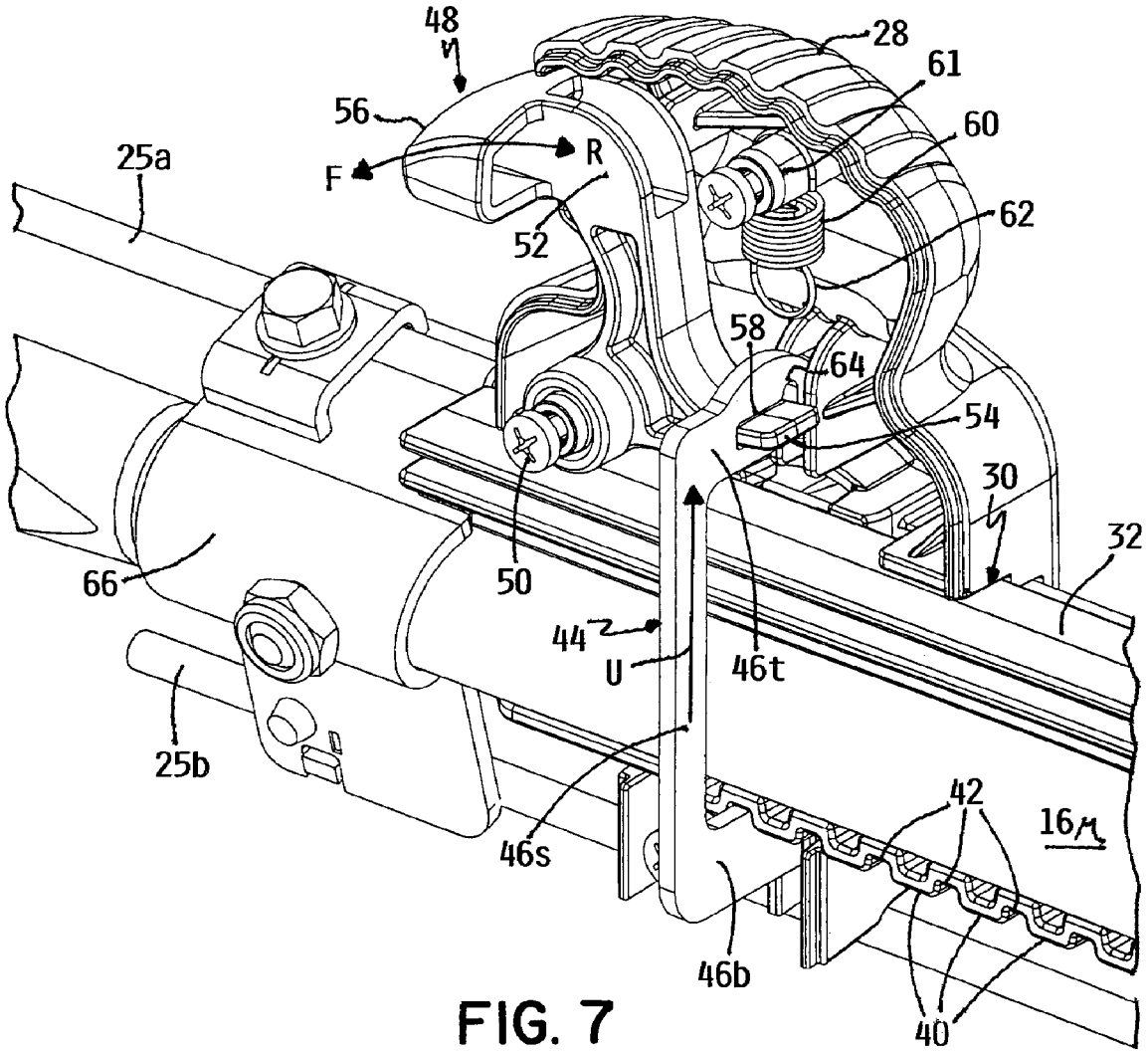
FIG. 7 is a perspective view similar to FIG. 6, but having a portion of the slidable hand grip broken away to illustrate the hand grip latch and the pivotal latch release for the latch.

FIG. 7 shows various details of latch 44 and a selectively operable latch release 48. Latch 44 is U-shaped with the open part of the U facing the inner side of handle tube $\mathbf{16}_r$. Thus, latch 44 has a top arm $\mathbf{46}_t$ overlying the top of handle tube $\mathbf{16}_r$ and a bottom arm $\mathbf{46}_b$ underlying rack 38. The top and bottom arms of latch 44 are connected together by a vertical side arm $\mathbf{46}_s$. Bottom arm $\mathbf{46}_b$ of latch 44 is dimensioned to fit within grooves 42 between adjacent teeth 40 of rack 38. When so engaged, latch 44 locks hand grip 22 in an adjusted position along handle tube $\mathbf{16}_r$.

Top arm $\mathbf{46}_t$ of latch 44 is connected to a pivotal latch release 48 that is carried inside hand grip 22. Latch release 48 pivots about a substantially horizontal pivot pin 50 carried on hand grip 22. Latch release 48 is in the form of a bellcrank lever with a front leg 52 and a rear leg 54 on opposite sides of pivot pin 50. Front leg 52 extends out through the front of hand grip 22 and includes a rounded button or head 56 on the front end thereof. Rear leg 54 of latch release 48 extends further into the interior of hand grip 22 and is connected to top arm $\mathbf{46}_t$ of latch 44. Top arm $\mathbf{46}_t$ of latch 44 has a slot 58 which receives rear leg 54 of latch release 48 to couple latch release 48 to latch 44.

A spring 60 extends down from a post 61 inside hand grip 22 and will have a lower hook 62 thereof hooked into some type of opening on top arm $\mathbf{46}_t$ of latch 44. Spring 60 is shown unhooked in FIG. 7. Normally, hook 62 on spring 60 will engage in the rounded hole 64 shown on top arm $\mathbf{46}_t$ of latch 44 to pull upwardly on latch 44 as shown by the arrow U. Thus, the biasing of spring 60 both raises bottom arm $\mathbf{46}_b$ of latch 44 into a locking engagement with rack 38 and also rotates latch release 48 forwardly on pivot pin 50 in the direction of the arrow F in FIG. 7, i.e. in a direction which causes head 56 of front leg 52 of latch release 48 to protrude more fully out of housing 26 of hand grip 22.

When the operator places his or her hand atop knob 28 of hand grip 22, the operator's fingers will overlie the front of knob 28. To unlock hand grip 22 to allow hand grip 22 to be slid up or down on handle tube $\mathbf{16}_r$, the operator need only push back on head 56 of latch release 48 to pivot latch release 48 rearwardly in the direction indicated by the arrow R in FIG. 7. Latch release 48 will pivot rearwardly on pivot pin 50 causing rear leg 54 of latch release 48 to push down on latch 44 until bottom arm $\mathbf{46}_b$ of latch 44 drops down and disengages rack 38. If the operator keeps his or her fingers held against latch release 48, then the operator can simply slide hand grip 22 upwardly or downwardly on handle tube $\mathbf{16}_r$. When a new desired position of hand grip 22 has been reached corresponding to a desired amount of rotation of chute 6, the operator need only let go of latch release 48. The biasing of spring 60 will then reset latch release 48 and latch 44 to their usual positions corresponding to the engaged position of latch 44.

As noted earlier, a pair of Bowden cables 23 connect slidable hand grip 22 to chute 6. These cables comprise a first cable $\mathbf{23}_a$ and a second cable $\mathbf{23}_b$ with the a and b suffixes simply being used to distinguish or differentiate between the first and second cables 23. A Bowden cable is a type of flexible cable used to transmit mechanical force or energy by the movement of an inner cable (most commonly of steel or stainless steel) relative to a hollow outer cable housing. For each Bowden cable 23 shown herein, the inner cable will be referred to as 24 and the outer cable housing will be referred to as 25, again with the a and b suffixes being used when necessary to distinguish between these components of the pair of Bowden cables $\mathbf{23}_a$ and $\mathbf{23}_b$.

The outer housing 25 of a Bowden cable 23 is typically clamped in place on the frame of the product with which it is used, which product here is snowthrower 4, with inner cable 24 free to slide back and forth within outer housing 25. For example, referring to FIG. 6, a first clamping bracket 66 is shown on handle tube $\mathbf{16}_r$ adjacent the lower end of guide rail 32 and rack 38. Outer housings 25 of both Bowden cables 23 are shown clamped to first clamping bracket 66 in FIGS. 6 and 7.

The outer housing $\mathbf{25}_a$ of the first Bowden cable $\mathbf{23}_a$ ends at first clamping bracket 66. However, the outer housing $\mathbf{25}_b$ of the second Bowden cable $\mathbf{23}_b$ continues up the length of handle tube $\mathbf{16}_r$ along the underside of handle tube $\mathbf{16}_r$ and enters into a pulley housing 68 where it is additionally clamped or restrained. Pulley housing 68 is located at the top of handle tube $\mathbf{16}_r$ above guide rail 32 and rack 38. In addition to these clamping locations, outer housings 25 of both Bowden cables 23 may be clamped to the frame of the snowthrower adjacent rotatable chute 7 or elsewhere.

Figure 8:
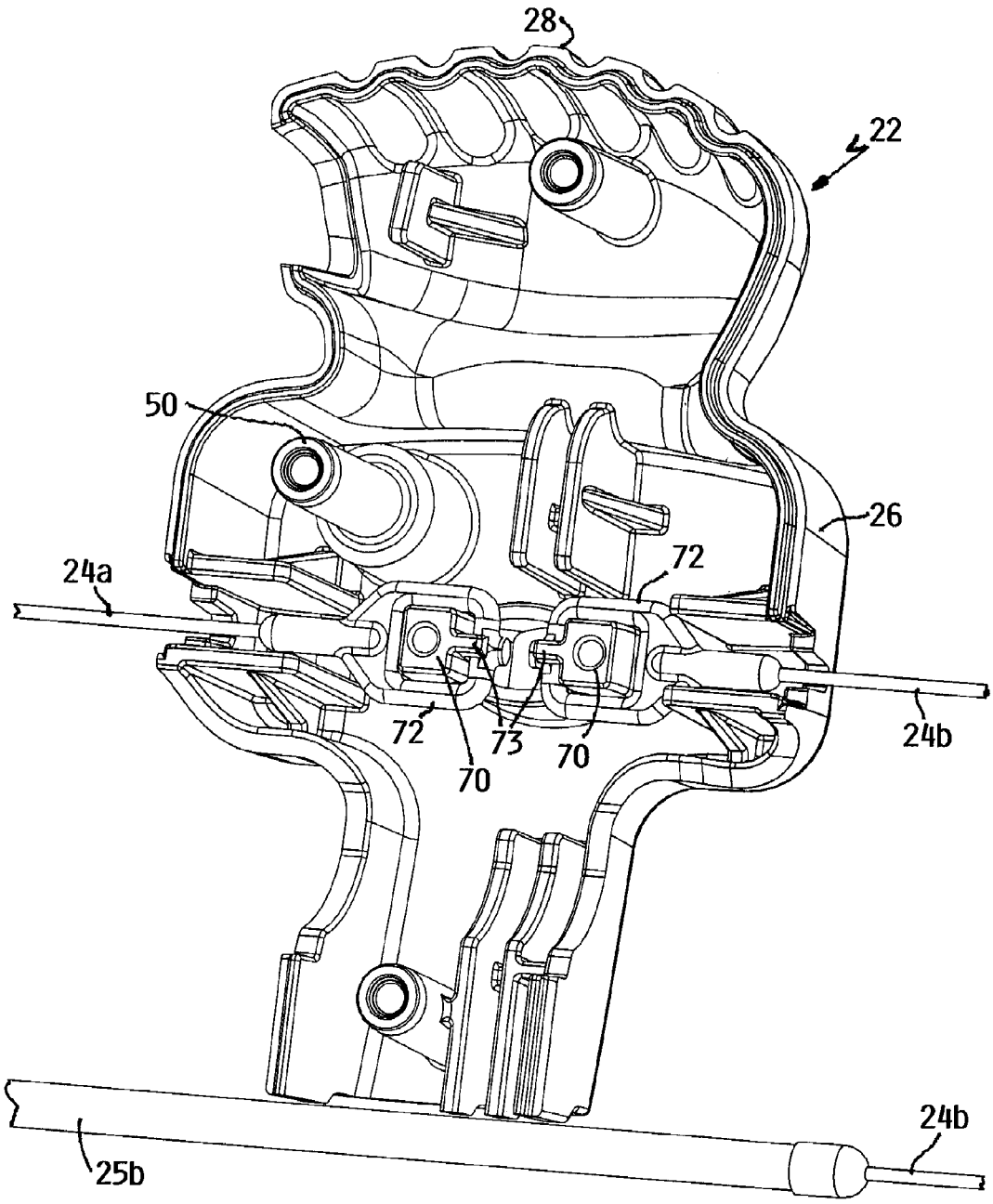
FIG. 8 is a perspective view similar to FIG. 7, but further having the latch and the latch release removed from the slidable hand grip to illustrate the connection of the inner cables to the hand grip.

Referring now to FIG. 8, inner cables 24 of both Bowden cables 23 are attached at their upper ends thereof to slidable hand grip 22 such that one inner cable 24 is always being pulled when slidable hand grip 22 is being slid on handle tube $\mathbf{16}_r$. Inner cables 24 have enlarged heads 72 received around posts 70 formed in the upper portion of housing 26 of hand grip 22. Heads 72 are simply hooked under tabs 73 on posts 70 and then dropped down onto posts 70 before the rest of hand grip 22 is assembled and are thereafter retained on posts 70 simply by the assembly of the rest of the components of hand grip 22 over posts 70. The inner cable $\mathbf{24}_a$ of the first Bowden cable $\mathbf{23}_a$ extends downwardly out of hand grip 22 through the front side of hand grip 22, i.e. the lower side of hand grip 22 when hand grip 22 is on handle tube $\mathbf{16}_r$. The inner cable $\mathbf{24}_b$ of the second Bowden cable $\mathbf{23}_b$ extends upwardly out of hand grip 22 through the rear side of hand grip 22, i.e. the upper side of hand grip 22 when hand grip 22 is on handle tube $\mathbf{16}_r$.

Obviously, if the inner cable $\mathbf{24}_b$ of the second Bowden cable $\mathbf{23}_b$ extends upwardly out of hand grip 22, then extends away from chute 6 of snowthrower 4 and not towards chute 6. Thus, the direction of inner cable $\mathbf{24}_b$ of the second Bowden cable has to change. This is accomplished by a rotatable guide pulley 74 contained in pulley housing 68 at the top end of handle tube $\mathbf{16}_r$. The inner cable $\mathbf{24}_b$ of the second Bowden cable passes around guide pulley 74 to change direction 180°. As noted previously, the outer housing $\mathbf{25}_b$ of the second Bowden cable $\mathbf{23}_b$ has its upper end fixed or restrained within pulley housing 68.

Figure 5:
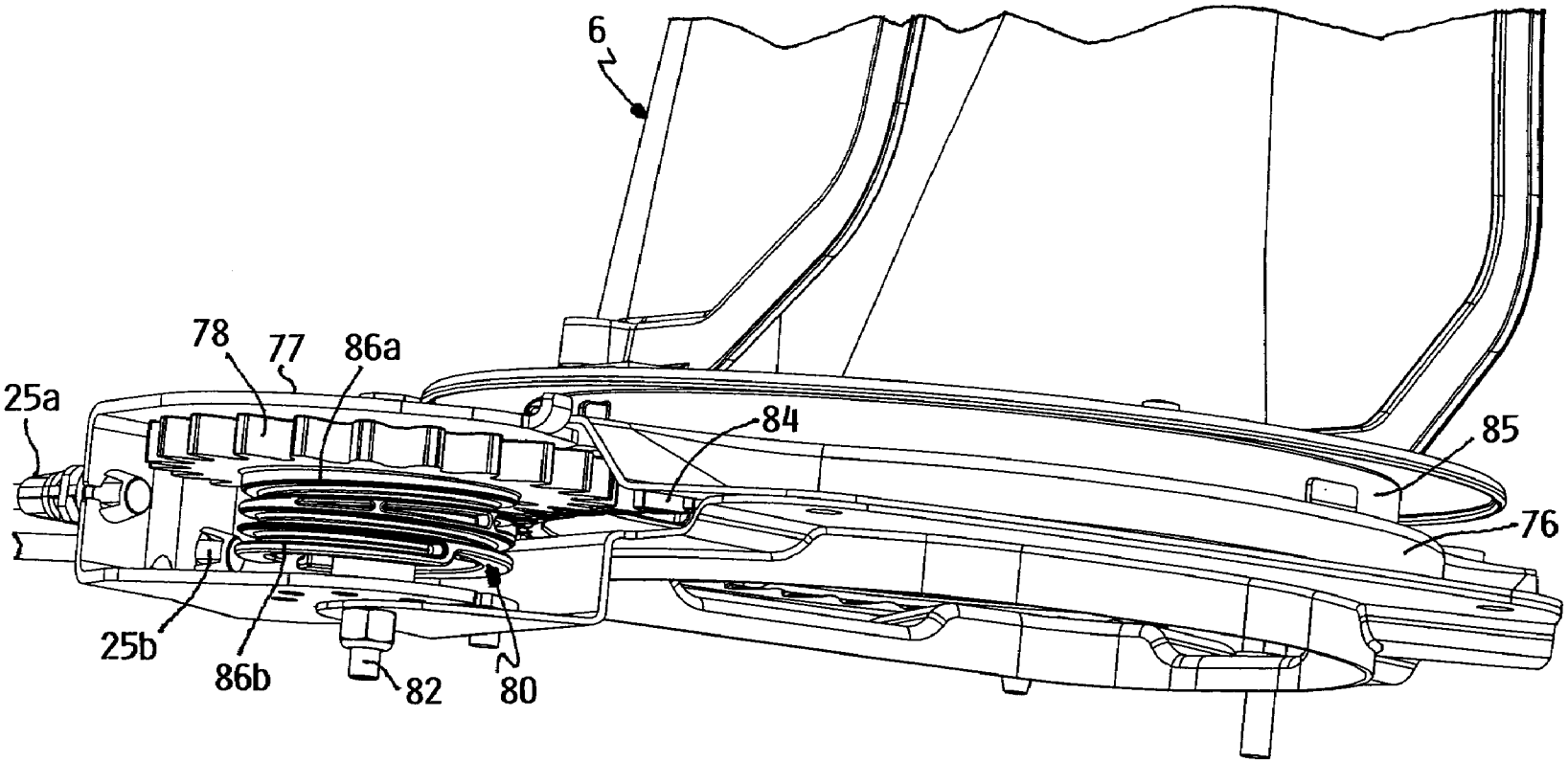
FIG. 5 is a perspective view of the bottom of the rotatable chute of the snowthrower of FIG. 1, particularly illustrating the combined pulley and gear that rotates the chute with the pulley having separate cable tracks for the pair of inner cables used to rotate the pulley and gear in opposite directions.

Referring now to FIG. 5, a gear housing 76 is contained on the frame of snowthrower 4 adjacent the bottom or base of chute 6. Gear housing 76 includes a side extension 77 that projects to one side of gear housing 76. Outer housings 25 of both Bowden cables 23 are clamped or fixed to the rear wall of side extension 77. Inner cables 24 extend into side extension 77, but are not shown in FIG. 5 for the purpose of clarity.

A combination drive gear 78 and drive pulley 80 is rotatably contained inside side extension 77 for rotation about a substantially vertical pivot 82. Drive gear 78 has its teeth engaged with teeth 84 of a driven gear 85 that is carried on the base of chute 6. Thus, when drive gear 78 rotates about pivot 82, the driven gear is rotated to thereby rotate or pivot chute 6 relative to snowthrower 4.

The bottom of drive gear 78 has a smaller diameter drive pulley 80 fixed thereto. Preferably, drive gear 78 and drive pulley 80 can be molded integrally together out of a relatively hard, durable plastic material. Or, drive pulley 80 could be made from plastic and drive gear 78 from metal with the two being affixed to one another. Alternatively, drive gear 78 and drive pulley 80 could be physically separated from one another and keyed to a rotatable shaft instead of rotating about a fixed pivot 82.

In any event, drive pulley 80 has a pair of helical, oppositely disposed, cable receiving tracks $\mathbf{86}_a$ and $\mathbf{86}_b$ around the circumference thereof. The lower end of inner cable $\mathbf{24}_a$ of the first Bowden cable $\mathbf{23}_a$ is inserted into one of these tracks, i.e. into track $\mathbf{86}_a$, with the head of the lower end of inner cable $\mathbf{24}_a$ being anchored or pinned to drive pulley 80 at the end of track $86_a$. The lower end of the inner cable $24_b$ of the second Bowden cable $23_b$ is similarly attached to the other track $86_b$ on drive pulley 80. As noted, tracks 86 are oppositely disposed relative to one another such that as one inner cable 24 is wound up into its track on drive pulley 80 the other inner cable 24 is unwinding from its track.

Each track 86 is long enough so that each inner cable 24 can be wound onto track 86 more than 360° without overlapping onto itself. This helps minimize the forces required for operating chute 6 down without having to put undesirable looseness into the system. In addition, while tracks 86 have been shown located on the circumference of a single drive pulley 80, tracks 86 could be placed on a pair of separate drive pulleys 80 with one track 86 being located on each drive pulley 80 as long as both drive pulleys 80 conjointly rotate together.

Figure 3:
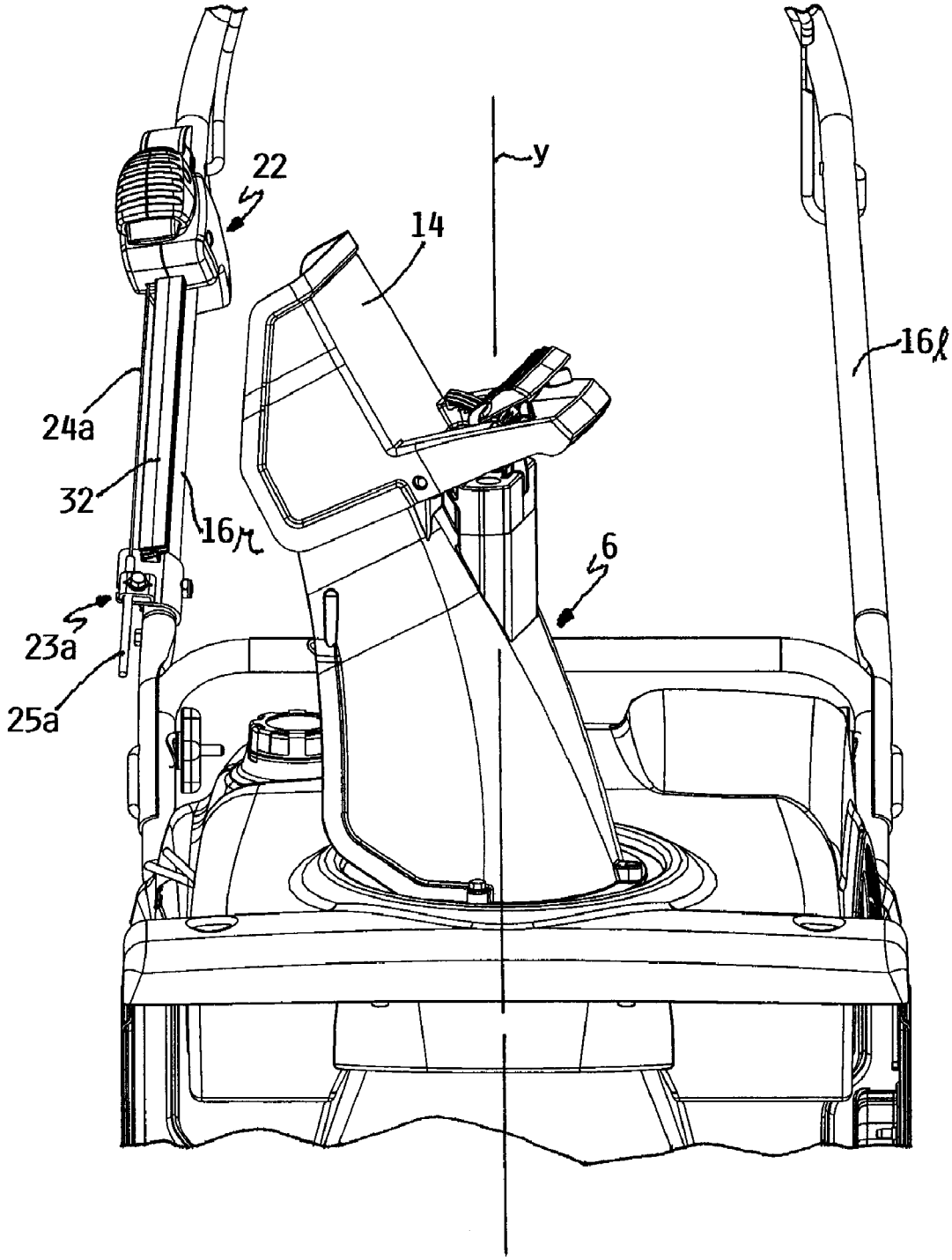
FIG. 3 is a partial front plan view similar to FIG. 1, but particularly illustrating the chute of the snowthrower having been rotated fully through its entire range of angular motion to point or be directed to the opposite side of the snowthrower housing.
Figure 4:
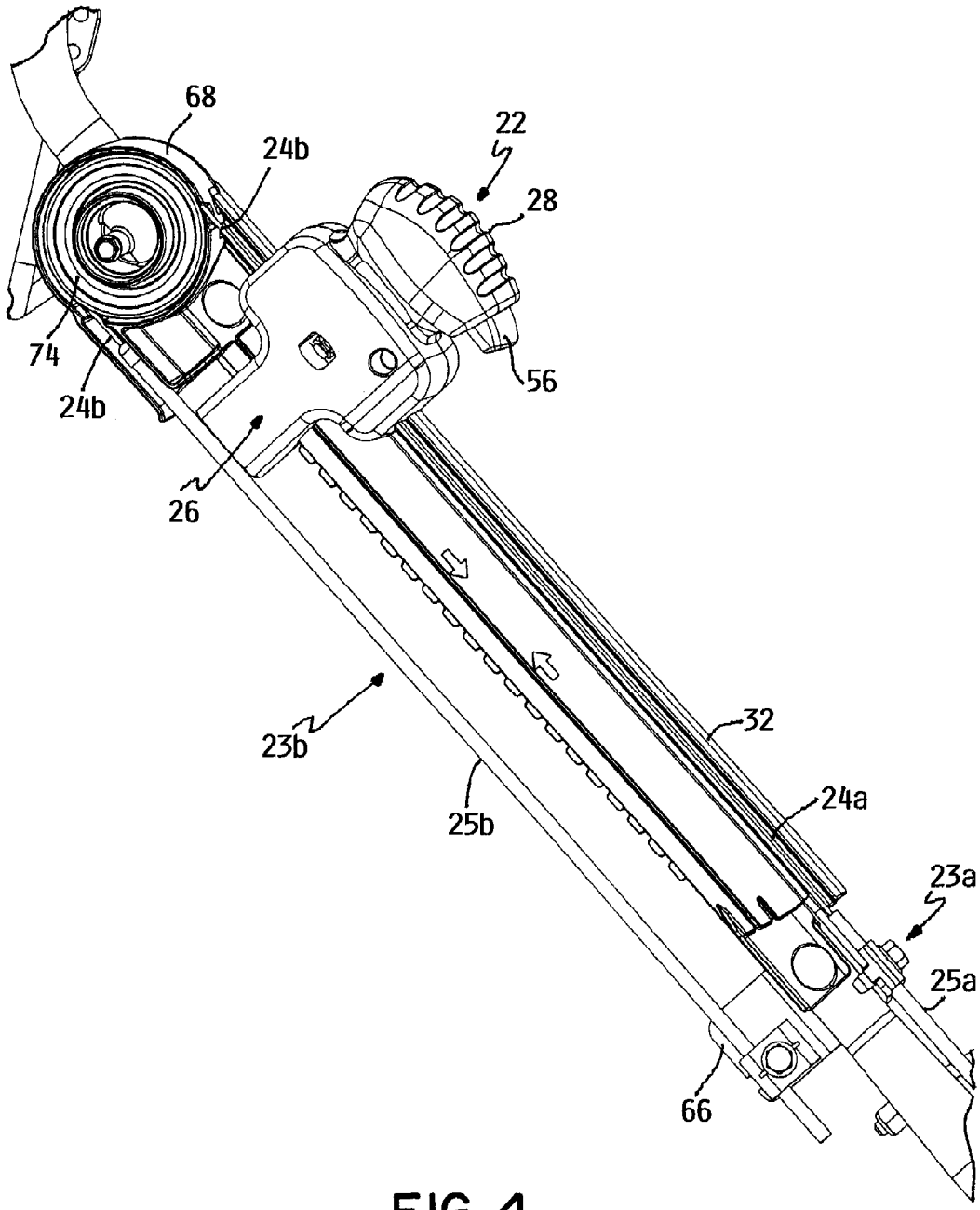
FIG. 4 is a partial side elevational view of one of the handle tubes of the handle assembly of the snowthrower of FIG. 1, particularly illustrating the slidable chute control of this invention carried on the handle tube with a portion of the pulley housing being broken away to illustrate the cable guide pulley used for one of the inner cables of the slidable chute control.

The circumference of drive pulley 80 is smaller than the length of guide rail 32 and the maximum distance of the sliding motion of hand grip 22. Thus, if hand grip 22 is fully slid up or down on handle tube $16_r$ the full length of its possible motion, drive pulley 80 will be rotated a sufficient number of rotations to rotate chute 6 through its full range of angular motion, from slightly in excess of 180° to about 230°. FIG. 1 shows hand grip 22 at the lower end of guide rail 32 with chute 6 being fully rotated to the right on snowthrower 4. Compare FIG. 1 to FIG. 3. FIG. 3 shows hand grip 22 at the upper end of guide rail 32 with chute 6 having been rotated in excess of 180° to its fully rotated position on the left of snowthrower 4. This is achieved by suitable dimensioning of the diameter of drive pulley 80, the diameter of drive gear 78, and the diameter of the driven gear or gear sector on chute 6. Drive gear 78 could be deleted with inner cables 24 directly attached to the ring of chute 6, but this requires a longer stroke on hand grip 22 in order to achieve the full range of adjustment of chute 6, and such a longer stroke obviously is not desirable.

It should be apparent how slidable control 2 of this invention operates. To rotationally adjust the position of chute 6, the operator need only grip hand grip 22, depress latch release 48 towards hand grip 22, and then move hand grip 22 either up or down handle tube $16_r$. During this movement of hand grip 22, the inner cable 24 of one Bowden cable 23 is being pulled to unwind that inner cable 23 off drive pulley 80, though not to completely detach that inner cable from drive pulley 80 since the lower end of that inner cable is anchored or fixed to the end of its respective track 86 on drive pulley 80. This pulling motion rotates drive pulley 80, and hence drive gear 78, to rotationally move chute 6. Simultaneously, this pulling motion causes drive pulley 80 to begin winding up the inner cable of the other Bowden cable. Thus, as the inner cable of one Bowden cable unwinds from the pulley by virtue of being pulled by hand grip 22, the inner cable of the other Bowden cable is simultaneously being wound up on drive pulley 80 at the same rate.

The slidable control 2 of this invention is simple and durable. It includes a single hand grip 22 that can be conveniently mounted on one of the existing handle tubes 16 of handle assembly 20 of snowthrower 4. Thus, there is no need to provide an escutcheon plate to mount the control and the control need not be centrally located in front of the operator. All the operator need do is to reach down, unlatch hand grip 22 by depressing latch release 48, and then slide hand grip 22 up and down handle tube $16_r$. Hand grip 22 is large enough so that this can be easily done by the operator even when the operator's hand is gloved.

Moreover, the use of dual flexible Bowden cables 23 of the type disclosed herein and how they connect to slidable hand grip 22 and drive pulley 80 are also advantageous. Cables 23 can be conveniently routed down along handle tube $16_r$ and then pass inside the rear of the housing of snowthrower 4 as shown in FIG. 1. Gear housing 76 and the connection of drive gear 78 to the driven gear of chute 6 are all located inside the housing of snowthrower 4. Thus, the use of elongated and exposed mechanical crank type linkages is avoided. The design of control 2 of this invention is simple, clean and efficient with few exposed parts.

While slidable hand grip 22 of the control of this invention has been shown on right handle tube $16_r$, it could be placed on left handle tube $16_l$ or on other portions of handle assembly 20. Sliding hand grip 22 down right handle tube $16_r$ rotates chute 6 to the left. This is an intuitive arrangement and is preferred. However, this arrangement could be reversed with downward motion of hand grip 22 rotating chute 6 to the right.

Other ways of coupling slidable hand grip 22 to chute 6 could be used for rotating chute 6. For example, a flexible but stiff strap that is stiff enough to be both pushed and pulled could be used with the strap wrapping at least partially around the base of chute 6. Thus, when hand grip 22 is slid down handle tube $16_r$, this strap would push on the base of chute 6 to rotate chute 6 in one direction while winding up around a portion of the circumference of the base of chute 6. Then, when hand grip 22 is slid up the handle, the strap would be pulled in the opposite direction and would unwind from chute 6. However, the use of the dual oppositely disposed Bowden cables 23, which result in a pulling force being applied to chute 6 regardless of the direction of movement of hand grip 22, is preferred over a combined push/pull connection to chute 6 through a flexible but sufficiently stiff strap.

Accordingly, this invention is to be limited only by the appended claims.

We claim:

1. An improved snowthrower of the type having a chute rotatable about a substantially vertical axis for directing a snow stream being thrown by the snowthrower, a handle assembly comprising a pair of upwardly and rearwardly extending, laterally spaced handle tubes, and a control on the snowthrower for operating the chute, wherein the improvement relates to the control which comprises:

(a) a slidable hand grip carried on one of the handle tubes of the snowthrower for sliding upwardly and downwardly along a portion of the length of the one handle tube, wherein the slidable handle grip has a passageway through which the one handle tube passes with the passageway substantially encircling the handle tube on all sides of the handle tube such that the slidable hand grip slides up and down around the one handle tube; and (b) at least one flexible connection member coupling the hand grip to the chute for rotating the chute in opposite directions when the hand grip is slid up and down, respectively, on the one handle tube wherein the flexible connection member has a portion carried on the handle assembly and another portion extending between the handle assembly and the chute, and wherein the portion of the flexible connection member carried on the handle assembly is carried only on the one handle tube.

2. The snowthrower of claim 1, further including an elongated guide rail fixedly mounted to the one handle tube, the guide rail further passing through a slideway in the hand grip to further guide the hand grip in its sliding motion with the hand grip sliding back and forth along the fixed guide rail and along the one handle tube as the hand grip moves through the range of motion thereof.

3. An improved snowthrower of the type having a chute rotatable about a substantially vertical axis for directing a snow stream being thrown by the snowthrower, a handle assembly comprising a pair of upwardly and rearwardly extending, laterally spaced handle tubes, and a control on the snowthrower for operating the chute, wherein the improvement relates to the control which comprises:

(a) a slidable hand grip carried on one of the handle tubes of the snowthrower for sliding upwardly and downwardly along a portion of the length of the one handle tube;

(b) at least one flexible connection member coupling the hand grip to the chute for rotating the chute in opposite directions when the hand grip is slid up and down, respectively, on the one handle tube; and (c) a latch movably carried on the hand grip for holding the hand grip in an adjusted position relative to the one handle tube, wherein the latch has a locking portion which engages a toothed rack on the one handle tube.

4. The snowthrower of claim 3, wherein the latch is biased by a spring to normally engage the locking portion of the latch with the toothed rack.

5. The snowthrower of claim 4, further including a movable latch release carried on the hand grip to move the locking portion of the latch away from the toothed rack to release the hand grip from the one handle tube to allow the hand grip to be slidably adjusted along the one handle tube.

6. The snowthrower of claim 5, wherein the bias of the spring is configured to also move the latch release relative to the hand grip so that a portion of the latch release normally extends out through a portion of the hand grip to be accessible to the operator.

7. An improved snowthrower of the type having a chute rotatable about a substantially vertical axis for directing a snow stream being thrown by the snowthrower, a handle assembly comprising a pair of upwardly and rearwardly extending, laterally spaced handle tubes, and a control on the snowthrower for operating the chute, wherein the improvement relates to the control which comprises:

(a) a slidable hand grip carried on one of the handle tubes of the snowthrower for sliding upwardly and downwardly along a portion of the length of the one handle tube;

(b) at least one flexible connection member coupling the hand grip to the chute for rotating the chute in opposite directions when the hand grip is slid up and down, respectively, on the one handle tube, wherein the at least one flexible connection member has a pair of lower ends connected to the chute and arranged relative thereto such that one lower end is pulled by sliding motion of the hand grip to rotate a drive pulley and to be unwound from the drive pulley while the other lower end is being pulled by the drive pulley to be wound onto the drive pulley; and (c) wherein the drive pulley is non-rotatably coupled to a drive gear such that the drive gear rotates with the drive pulley, wherein the drive gear is connected to a driven gear on the chute to rotate the chute when the drive gear is rotated by rotation of the drive pulley.

8. The snowthrower of claim 7, wherein the at least one flexible connection member comprises a pair of separate connection members with the pair of lower ends comprising the lower ends of the separate connection members, wherein the drive pulley has separate, oppositely disposed tracks in which lower ends of the connection members are anchored, the separate connection members winding and unwinding on the pulley in the separate tracks provided therefor.

9. The snowthrower of claim 8, wherein the separate tracks for the connection members are helically disposed around a circumference of the drive pulley.

10. The snowthrower of claim 9, wherein upper ends of the connection members are anchored in the slidable hand grip and extend away from the hand grip in opposite directions such that the one connection member is pulled upwardly when the hand grip is slid upwardly and the other connection member is pulled downwardly when the hand grip is slid downwardly.

11. The snowthrower of claim 10, wherein the connection members comprise inner cables of a pair of Bowden cables each of which has an inner cable that slides within an outer cable housing, wherein the outer cable housings of the Bowden cables are clamped both to the one handle tube and to a frame of the snowthrower.

* * * * *